US010854179B2

(12) United States Patent
Miyajima

(10) Patent No.: US 10,854,179 B2
(45) Date of Patent: Dec. 1, 2020

(54) CYMBAL SUPPORT AND METHOD FOR USING CYMBAL SUPPORT

(71) Applicant: Mizuho Miyajima, Tachikawa (JP)

(72) Inventor: Takaya Miyajima, Tachikawa (JP)

(73) Assignee: Mizuho Miyajima, Tokyo (JP)

( * ) Notice: Subject to any disclaimer, the term of this patent is extended or adjusted under 35 U.S.C. 154(b) by 0 days.

(21) Appl. No.: 16/341,378

(22) PCT Filed: Oct. 24, 2017

(86) PCT No.: PCT/JP2017/038400

§ 371 (c)(1),
(2) Date: Apr. 11, 2019

(87) PCT Pub. No.: WO2018/084026

PCT Pub. Date: May 11, 2018

(65) Prior Publication Data

US 2020/0058276 A1 Feb. 20, 2020

(30) Foreign Application Priority Data

Nov. 1, 2016 (JP) ..... 2016-213991

(51) Int. Cl.
*G10G 5/00* (2006.01)
*G10D 13/06* (2020.01)

(52) U.S. Cl.
CPC ..... *G10G 5/005* (2013.01); *G10D 13/06* (2013.01)

(58) Field of Classification Search
CPC ..... G10G 5/005; G10D 13/06; G10D 13/00
See application file for complete search history.

(56) References Cited

U.S. PATENT DOCUMENTS

| | | | | |
|---|---|---|---|---|
| 5,969,281 | A | 10/1999 | Suenaga | |
| 9,355,625 | B1 * | 5/2016 | Takegawa | G10D 13/06 |
| 2005/0087059 | A1 | 4/2005 | Hsieh | |
| 2006/0156910 | A1 | 7/2006 | Yoshino | |
| 2007/0079687 | A1 | 4/2007 | Hsieh | |
| 2013/0125735 | A1 | 5/2013 | Mori et al. | |

(Continued)

FOREIGN PATENT DOCUMENTS

| | | |
|---|---|---|
| CN | 202258288 | 5/2012 |
| GB | 591800 | 8/1947 |
| JP | 55-16555 | 2/1980 |

(Continued)

OTHER PUBLICATIONS

International Search Report dated Jan. 16, 2018 in corresponding PCT International Application No. PCT/JP2017/038400, 6 pages.

(Continued)

*Primary Examiner* — Kimberly R Lockett
(74) *Attorney, Agent, or Firm* — Ohlandt, Greeley, Ruggiero & Perle, L.L.P.

(57) ABSTRACT

A cymbal support includes a support part having a solid inverted bowl-shaped curved part that contacts with the cymbal and a through hole through which a shaft rod penetrates at a central axis. An opening of a through hole at a side of the bent part of the cymbal support is chamfered in a curved shape or straightly, the support part has hardness from 25 to 80 degrees, and is made of one of, or a combination of two or more of leather, cork, felt, silicone resin and rubber sponge.

12 Claims, 11 Drawing Sheets

(56) References Cited

U.S. PATENT DOCUMENTS

| | | | |
|---|---|---|---|
| 2014/0096665 | A1 | 4/2014 | Nakata et al. |
| 2017/0076703 | A1 | 3/2017 | Miyata |

FOREIGN PATENT DOCUMENTS

| | | |
|---|---|---|
| JP | 9-325767 | 12/1997 |
| JP | 2006-201334 | 8/2006 |
| JP | 2014-77864 | 5/2014 |
| JP | 2015-227966 | 12/2015 |

OTHER PUBLICATIONS

Extended European Search Report dated Jun. 23, 2020 in corresponding European Application No. 17868340.5, 9 pages.

* cited by examiner

CYMBAL SUPPORT AND METHOD FOR USING CYMBAL SUPPORT

TECHNICAL FIELD

The present disclosure relates to a cymbal support for holding a cymbal on a stand shaft rod of a stand and usage thereof.

BACKGROUND ART

Conventionally, a cymbal support for holding a cymbal on a stand shaft rod of a stand and for playing the cymbal is used.

For example, felt washers described in Patent Literature 1 and Patent Literature 2 are general examples of cymbal supports. The felt washer in Patent Literature 1 is thick cylindrical felt. A surrounding of a hall of a cymbal is sandwiched from upside and downside with two felt washers, and a butterfly nut is screwed to a bar-shaped holder part of the stand from above the felt washer at the upside, and therefore the cymbal is fixed to the holder part (the felt washer in Patent Literature 2 is used in a similar way).

As described above, a felt washer as a conventional cymbal support is placed from upside and downside of a cymbal exactly like a washer forming a surface, presses the surrounding surface of the hall of a cymbal, and fixes the cymbal.

CITATION LIST

Patent Literature

Patent Literature 1: Unexamined Japanese Patent Application Kokai Publication No. H9-325767

Patent Literature 2: Unexamined Japanese Patent Application Kokai Publication No. 2014-77864

SUMMARY OF INVENTION

However, a conventional cymbal support has a surface that closely fits a cymbal and suppresses a free movement and vibration of the cymbal. Therefore, the intrinsic sound of the cymbal is impaired.

The present disclosure is made in consideration of the above-described situation, and provides a cymbal support that reduces suppressing of movement and vibration of the cymbal and secures the intrinsic sound of the cymbal while supporting the cymbal, and usage thereof.

A cymbal support according to a first aspect of the present disclosure includes a curved part having a solid inverted bowl shape, the curved part being configured to attach to the cymbal; and a support part having a through hole at a central axis through which the shaft rod penetrates.

The cymbal support according to a second aspect of the present disclosure is characterized in that the support part includes a columnar base on a side facing the curved part.

The cymbal support according a third aspect of the present disclosure is characterized in that an opening of the through hole on a curved part side of the support part is chamfered in a curved shape or straightly.

The cymbal support according to a fourth aspect of the present disclosure is characterized in that a chamfering of the opening of the through hole on the curved part side of the support part is in a curved shape with a radius from 1 mm to 3 mm.

The cymbal support according to a fifth aspect of the present disclosure is characterized in that a material of the support part is one of, or a combination of two of more of leather, cork, felt, silicone resin and rubber sponge.

The cymbal support according to a sixth aspect of the present disclosure is characterized in that the support part is 25 degrees to 80 degrees in hardness.

The cymbal support according to a seventh aspect of the present disclosure is characterized in that the support part is 8 mm to 30 mm in height, 20 mm to 45 mm in diameter of a bottom surface, and 10 mm to 30 mm in radius of a degree of curvature of the curved part.

The cymbal support according to an eighth aspect of the present disclosure is characterized in that the support part is 17 mm in height, 34 mm in diameter of a bottom surface, 40 degrees in hardness, and 25.5 mm in radius of a degree of curvature of the curved part, and the opening of the through hole on the curved part side of the support part is chamfered in a curved shape with a radius of 1 mm.

Usage of a cymbal support according to a ninth aspect of the present disclosure includes below the cymbal, arranging a first cymbal support according to any one of claims 1 to 8 so that a curved part is disposed at a cymbal side with the shaft rod penetrating through a through hole, disposing the cymbal on the first cymbal support, and on the cymbal, arranging a second cymbal support according to any one of claims 1 to 8 so that a curved part is disposed at the cymbal side with the shaft rod penetrating through a through hole.

The present disclosure can reduce suppressed movement and vibration of a cymbal and secure an intrinsic sound of the cymbal while supporting the cymbal.

DESCRIPTION OF EMBODIMENTS

Figure 1:
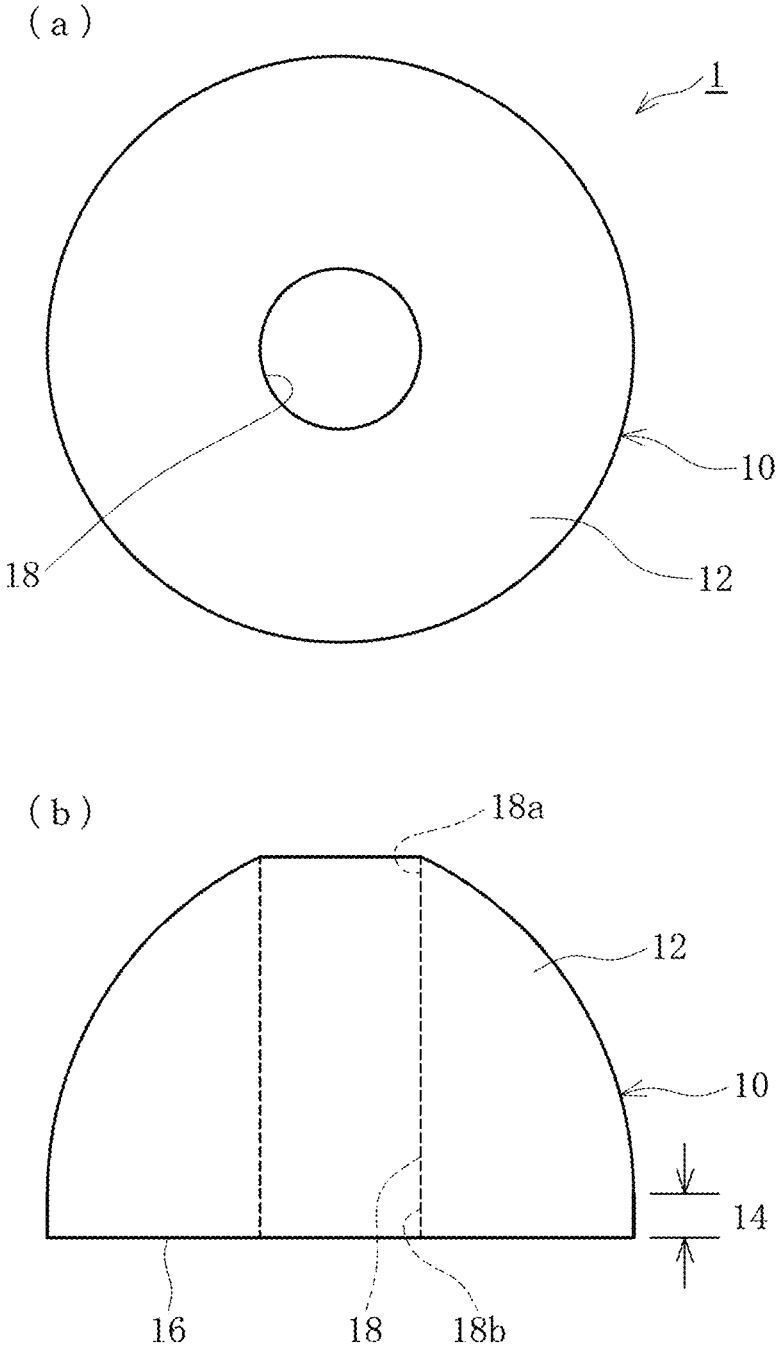
FIG. 1 is an explanatory diagram illustrating an embodiment of an example of a cymbal support according to the present disclosure.
Figure 2:
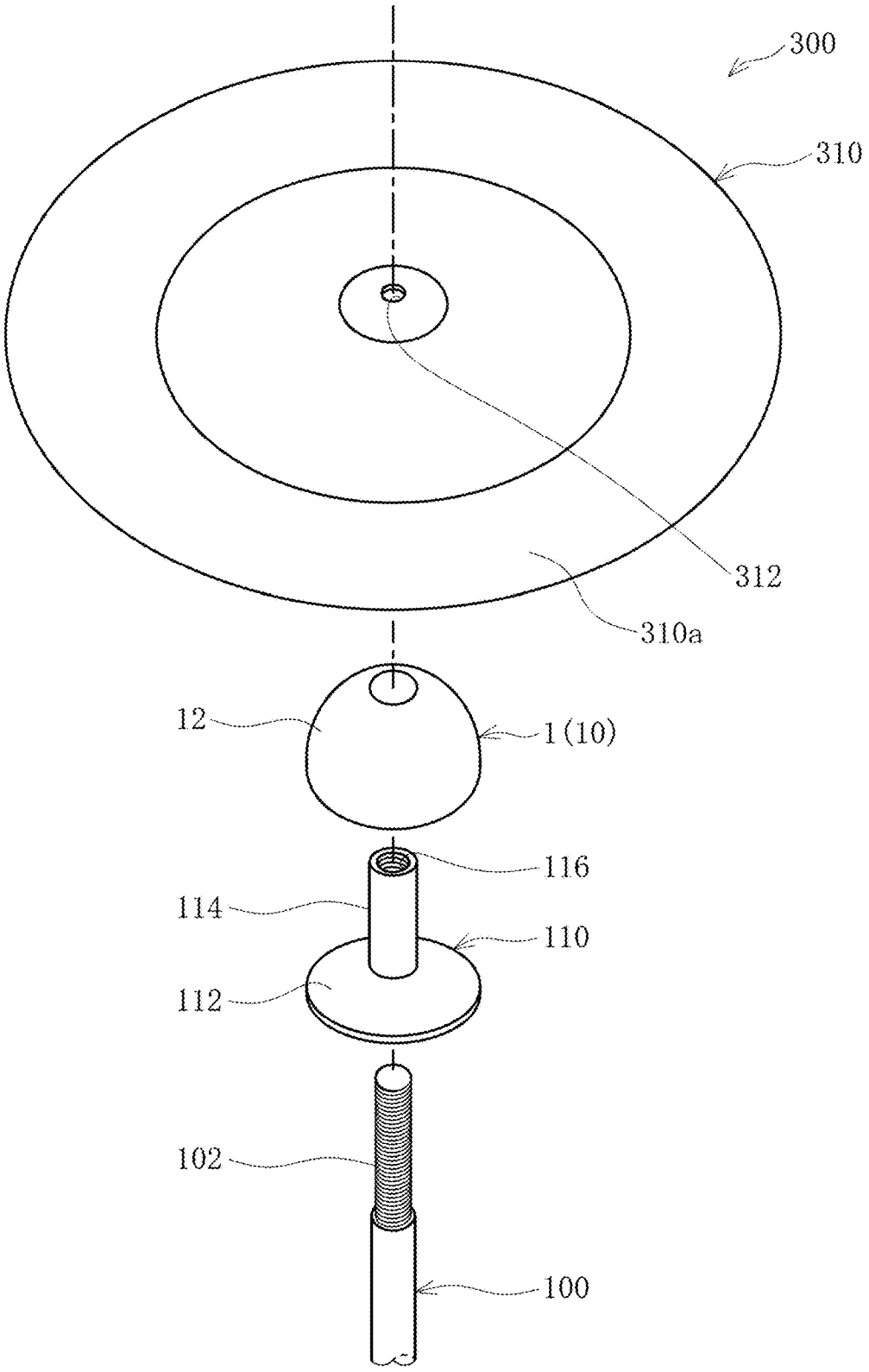
FIG. 2 is an explanatory diagram illustrating an example of usage of the cymbal support.
Figure 3:
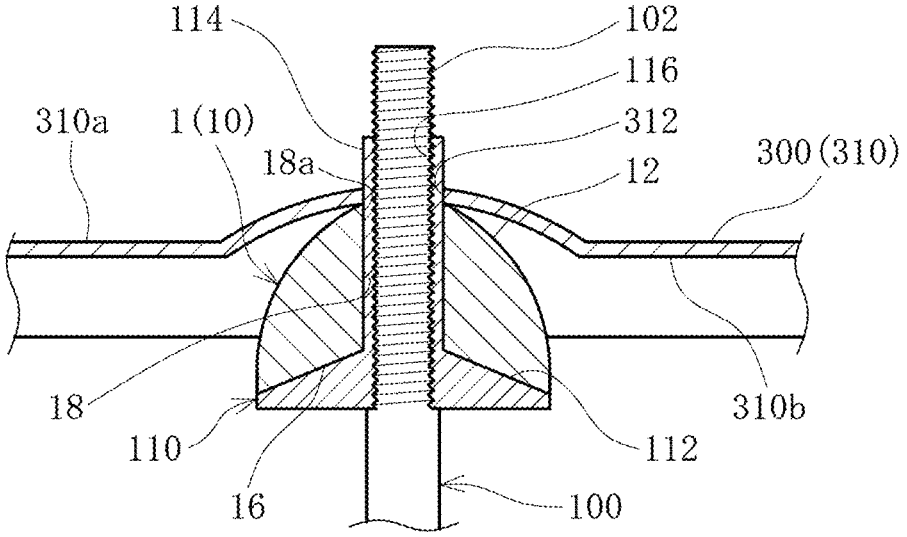
FIG. 3 is an explanatory diagram illustrating an example of usage of the cymbal support.
Figure 4:
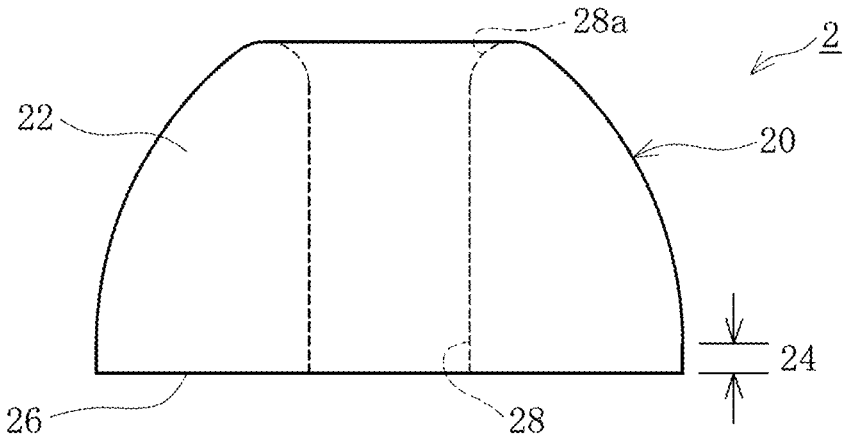
FIG. 4 is an explanatory diagram illustrating Embodiment 1 of a cymbal support according to the present disclosure.
Figure 5:
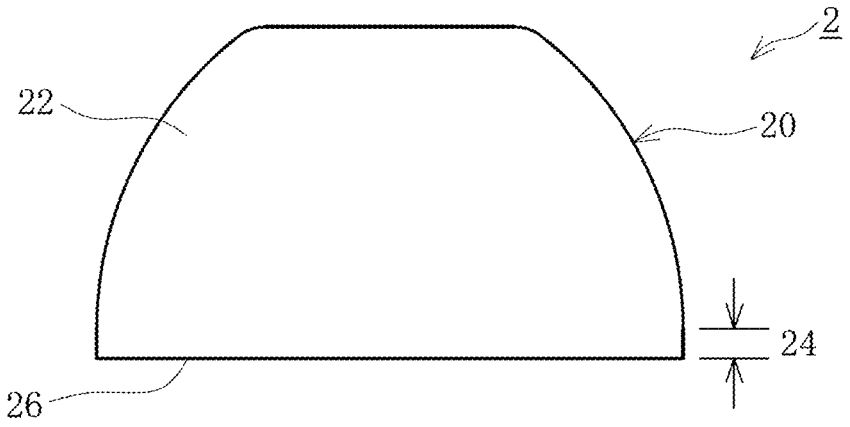
FIG. 5 is an explanatory diagram illustrating Embodiment 1 of the cymbal support according to the present disclosure.
Figure 6:
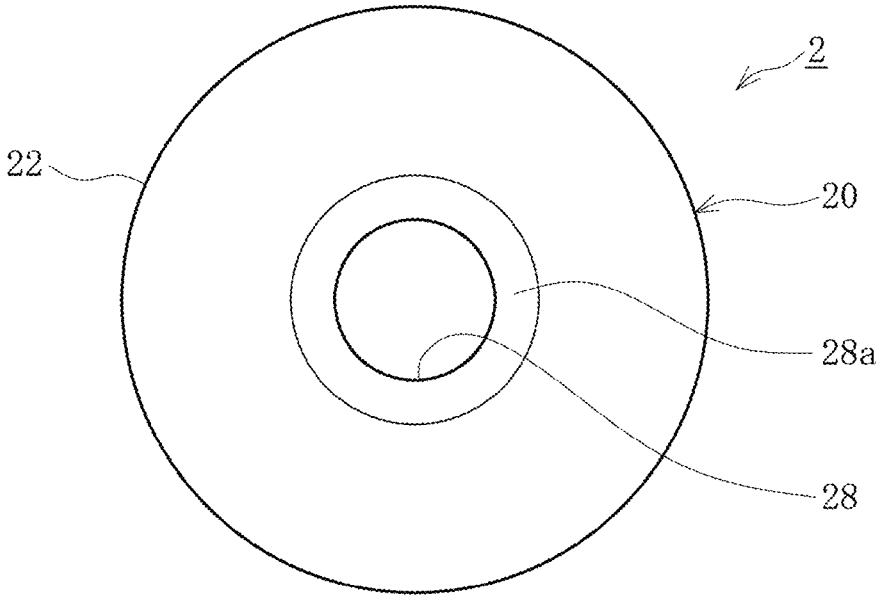
FIG. 6 is an explanatory diagram illustrating Embodiment 1 of the cymbal support according to the present disclosure.
Figure 7:
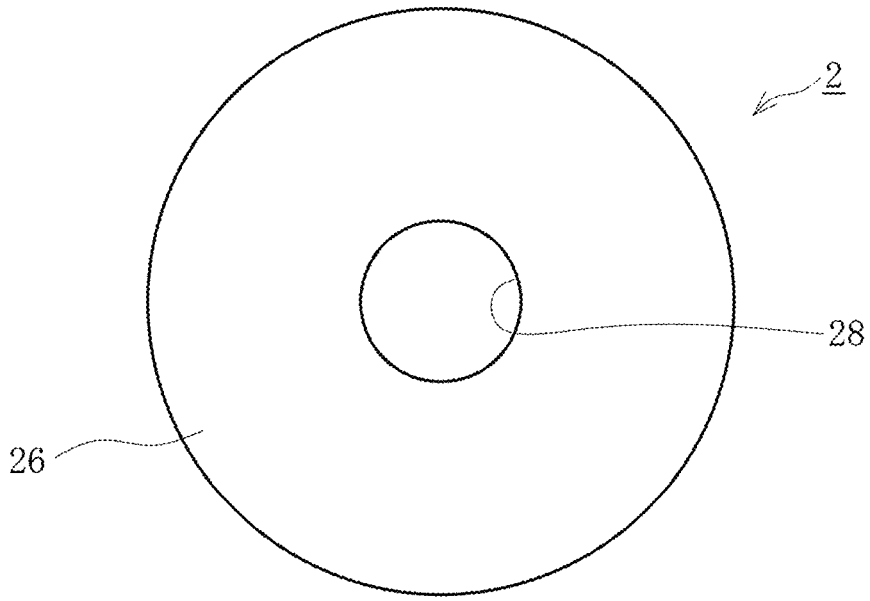
FIG. 7 is an explanatory diagram illustrating Embodiment 1 of the cymbal support according to the present disclosure.

Next, with reference to the figures, the embodiments of the present disclosure are described in detail. FIG. 1 is an explanatory diagram illustrating an embodiment of an example of a cymbal support according to the present disclosure. FIGS. 2 and 3 are explanatory diagrams illustrating an example of usage of the cymbal support.

The cymbal support 1 according to the present disclosure is for a stand shaft rod 100 of a stand to hold a cymbal 300. The cymbal support 1 illustrated in FIGS. 1 to 3 has the most typical shape. The cymbal support 1 includes a support part 10. The support part 10 has a solid inverted substantially bowl-shaped curved part 12 that a cymbal 300 comes into contact, and also has a through hole 18 at a central axis through which a stand shaft rod 100 penetrates. As described later, a portion of the curved part 12 closely fits the cymbal 300. Also, the cymbal support 1 (support part 10) includes a columnar base 14 on the side of a surface (bottom surface 16) that opposes the curved part 12. The base 14 is not necessarily essential, however, there is a case the base 14 is preferably included depending on usage described later.

A material of the cymbal support 1 (support part 10) may not shrink extremely because of the weight of the cymbal 300, may have adequate elasticity, and may not break in a predetermined period of time enduring the vibration of the cymbal 300. The material of the cymbal support 1 (support part 10) is preferably one of, or a combination of two or more of leather, cork, felt, silicone resin and rubber sponge. In addition, the cymbal support 1 (support part 10) preferably has hardness of 25 to 80 degrees. However, considering the tone of the cymbal 300, there is a case that the cymbal support 1 (support part 10) more preferably has hardness of 25 to 50 degrees. The hardness recited in the present application is defined in JIS K 6253 type A (JIS K 6253 durometer type A (shore A)).

The curved part 12 of the support part 10 is necessary to have a degree of curvature that only a portion of the curved part 12 surrounding an opening 18*a* of the through hole 18 closely fits the cymbal 300, and the entirety of the curved part 12 does not closely fit the cymbal 300. In the support part 10 of the cymbal support 1 illustrated in FIGS. 1 to 3, the diameter of the bottom surface 16 is 38 mm to 45 mm, the overall height is 20 mm to 30 mm, the degree of curvature of the curved part 12 is 20 mm to 30 mm in radius. The height of the base 14 is 1 mm to 5 mm. The numeric value of the size of the support part 10 of the cymbal support 1 is appropriately selected according to the size of the cymbal 300 and/or the like. For other sizes, for example, one with a small size may have a diameter of the bottom surface of 30 mm to 38 mm, an overall height of 8 mm to 20 mm, and a degree of curvature of the curved part 12 of 10 mm to 20 mm in radius. A preferable range of size is 8 mm to 30 mm in a height of a support part 10, 20 mm to 45 mm in a diameter of a bottom surface 16, 10 mm to 30 mm in a radius of a degree of curvature of a curved part 12.

Next, usage of the cymbal support 1 is described. As illustrated in FIGS. 2 and 3, on a stand of the cymbal 300, a stand shaft rod 100 is standing, and a screw 102 is arranged by drilling a thread at a top end. A fixer 110 is screwed to the screw 102 of the stand shaft rod 100. Specifically, the fixer 110 has a disc-shaped plate 112 whose upper surface inclines from the center to the periphery, and a cylinder 114 that stands upwards from the center of the axis of the plate 112, and screw threads are drilled on the inner peripheral surface of the cylinder 114, forming a screw thread portion 116.

By screwing the screw thread portion 116 of the fixer 110 to the stand shaft rod 100, the fixer 110 is fixed to the stand shaft rod 100. Then, the cymbal support 1 (support part 10) is fitted into the fixer 110. Specifically, the cymbal support 1 (support part 10) is inserted so that the bottom surface 16 of the support part 10 faces the upper surface of the plate 112 of the fixer 110, and the cylinder 114 of the fixer 110 is inserted to the through hole 18 of the support part 10. Then, as illustrated in FIG. 3, the bottom surface 16 of the support part 10 is fixed by closely fitting along the inclination of the upper surface of the plate 112 of the fixer 110. At this time, a tip of the cylinder 114 of the fixer 110 basically projects above the opening 18*a* of the support part 10.

In this state, a lower surface 310*b* of the cymbal part 310 of the cymbal 300 is arranged on the side of the cymbal support 1 (support part 10) and the side of the fixer 110, insert the screw 102 of the stand shaft rod 100 into the cymbal hole 312, moreover, insert the cylinder 114 of the fixer 110, the lower surface 310*b* of the cymbal part 310 is disposed on the curved part 12 of the cymbal support 1 (support part 10), and the cymbal part 310 closely fits because of the weight thereof.

The cymbal support 1 of the above-described configuration can reduce suppressed movement and vibration of the cymbal 300 and secure an intrinsic sound of the cymbal 300 while supporting the cymbal 300.

Embodiment 1

In the following embodiments, examples of cymbal supports 1 having other forms are described. FIGS. 4 to 7 are explanatory diagrams illustrating Embodiment 1 of the cymbal support according to the present disclosure. A cymbal support 2 of Embodiment 1 includes a support part 20. The support part 20 has a solid inverted substantially bowl-shaped curved part 22 that a cymbal 300 comes into contact, and also has a through hole 28 at a central axis through which a stand shaft rod 100 penetrates. Also, the cymbal support 2 has a columnar base 24 on a side of a surface (bottom surface 26) that opposes the curved part 22 of the support part 20.

In addition, an opening 28*a* of the through hole 28 on the side of the curved part 22 of the support part 20 is chamfered in a curved shape. When the chamfering of the opening 28*a* is in a curved shape, a preferred radius is 1 mm to 3 mm. Although the chamfering of the opening 28*a* of the cymbal support 2 (support part 20) in FIGS. 4 to 7 is in a curved shape, the chamfering may be straight.

A material, hardness and usage of the cymbal support 2 (support part 20) are similar to those of the cymbal support 1 (support part 10). A size and a degree of curvature of the curved part of the cymbal support 2 (support part 20) may be in a range described with the cymbal support 1 (support part 10), more specifically, for example, a diameter of the bottom surface 26 is approximately 40 mm, an overall height is approximately 22 mm, a degree of curvature of the curved part 22 is approximately 25.5 mm in radius. A height of the base 24 is approximately 2 mm. A degree of curvature of the curved-shape chamfering of the opening 28*a* is approximately 3 mm in radius.

When the opening 28*a* of the through hole 28 on the side of the curved part 22 is chamfered in a curved shape or straightly as in the cymbal support 2 (support part 20), even when the cymbal 300 vibrates violently, the effect of the vibration does not propagate directly to the opening 28*a*, and therefore the cymbal support 2 is less likely to break.

Embodiment 2

Figure 8:
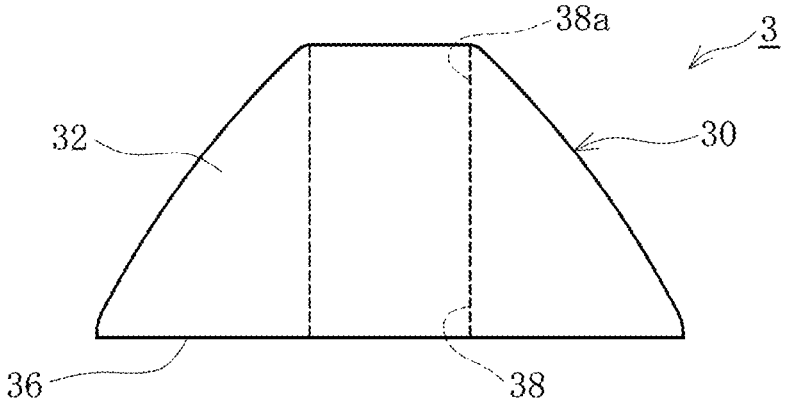
FIG. 8 is an explanatory diagram illustrating Embodiment 2 of a cymbal support according to the present disclosure.

FIG. 8 is an explanatory diagram illustrating Embodiment 2 of a cymbal support according to the present disclosure. A cymbal support 3 of Embodiment 2 includes a support part 30. The support part 30 has a solid inverted substantially bowl-shaped curved part 32 that a cymbal 300 comes into contact, and also has a through hole 38 at a central axis through which a stand shaft rod 100 penetrates.

The curved part 32 of the cymbal support 3 (support part 30) has a relatively straight but curved shape. Even with the shape, the curved part 32 of the support part 30 has a degree of curvature that only a surrounding of an opening 38*a* on the side of the curved part 32 of the through hole 38 closely fits the cymbal 300, and the entirety of the curved part 32 does not closely fit the cymbal 300.

A material, hardness and usage of the cymbal support 3 (support part 30) are similar to those of the cymbal support 1 (support part 10).

Embodiment 3

Figure 9:
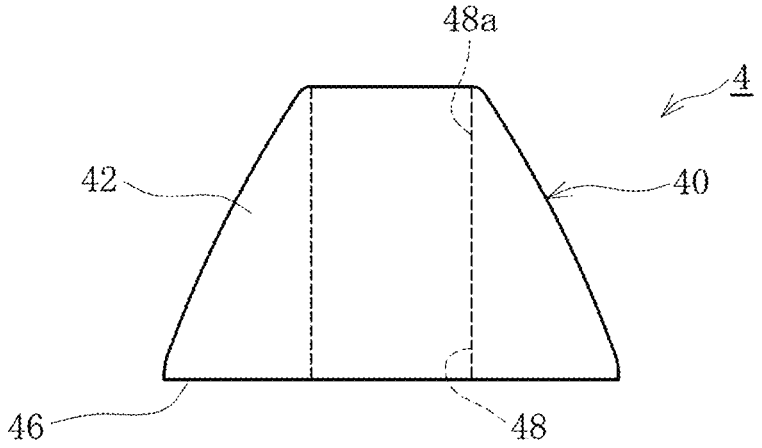
FIG. 9 is an explanatory diagram illustrating Embodiment 3 of a cymbal support according to the present disclosure.

FIG. 9 is an explanatory diagram illustrating Embodiment 3 of the cymbal support according to the present disclosure. A cymbal support 4 of Embodiment 3 includes a support part 40. The support part 40 has a solid inverted substantially bowl-shaped curved part 42 that a cymbal 300 comes into contact, and also has a through hole 48 at a central axis through which a stand shaft rod 100 penetrates.

The curved part 42 of the cymbal support 4 (support part 40) has a relatively straight but curved shape. Even with the shape, the curved part 42 of the support part 40 has a degree of curvature that only a surrounding of an opening 48*a* on the side of the curved part 42 of the through hole 48 closely fits the cymbal 300, and the entirety of the curved part 42 does not closely fit the cymbal 300. The inclination of the curved part 42 of the cymbal support 4 (support part 40) is steeper than an inclination of the curved part 32 of the cymbal support 3 (support part 30).

A material, hardness and usage of the cymbal support 4 (support part 40) are similar to those of the cymbal support 1 (support part 10).

Embodiment 4

Figure 10:
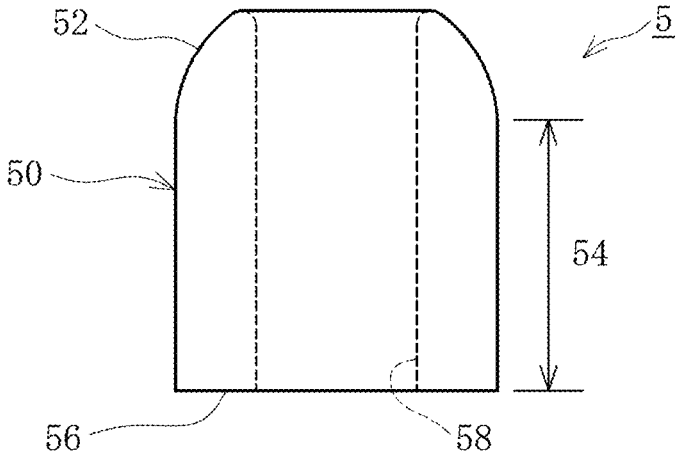
FIG. 10 is an explanatory diagram illustrating Embodiment 4 of a cymbal support according to the present disclosure.

FIG. 10 is an explanatory diagram illustrating Embodiment 4 of the cymbal support according to the present disclosure. A cymbal support 5 of Embodiment 4 includes a support part 50. The support part 50 has a solid inverted substantially bowl-shaped curved part 52 that a cymbal 300 comes into contact, and also has a through hole 58 at a central axis through which a stand shaft rod 100 penetrates.

An upper portion of the curved part 52 of the cymbal support 5 (support part 50) has a gently curved shape, however, unlike other cymbal supports, the curved part 52 is short, and has a columnar base 54 being relatively tall on the other side that is the surface (bottom surface 56) facing the curved part 52 of the support part 50. The degree of curvature of the curved part 52 is mostly similar to those of the cymbal support 1 (support part 10) and the cymbal support 2 (support part 20).

The material, hardness and usage of the cymbal support 5 (support part 50) are similar to those of the cymbal support 1 (support part 10).

Embodiment 5

Figure 11:
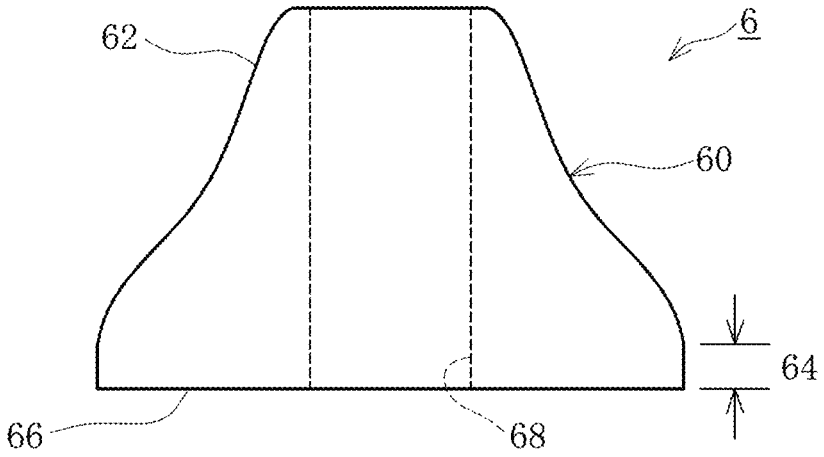
FIG. 11 is an explanatory diagram illustrating Embodiment 5 of a cymbal support according to the present disclosure.

FIG. 11 is an explanatory diagram illustrating Embodiment 5 of a cymbal support according to the present disclosure. A cymbal support 6 of Embodiment 5 includes a support part 60. The support part 60 has a solid inverted substantially bowl-shaped curved part 62 that a cymbal 300 comes into contact, and also has a through hole 68 at a central axis through which a stand shaft rod 100 penetrates. Also, the cymbal support 6 has a columnar base 64 on a side of a surface (bottom surface 66) that opposes the curved part 62 of the support part 60.

An entirety of the curved part 62 of the cymbal support 6 (support part 60) is curved, however, has a constriction curve near a middle section.

A material, hardness and usage of the cymbal support 6 (support part 60) are similar to those of the cymbal support 1 (support part 10).

Embodiment 6

Figure 12:
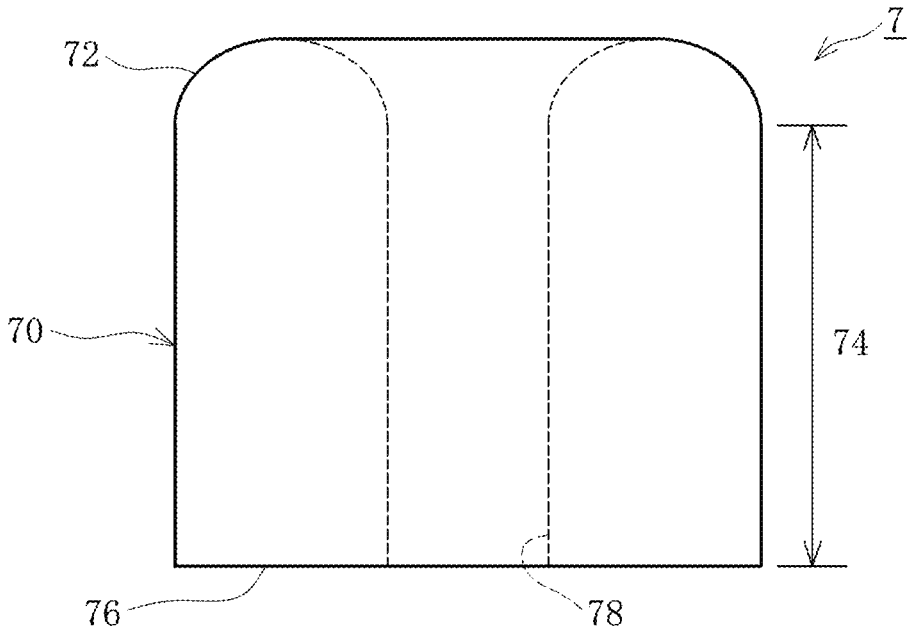
FIG. 12 is an explanatory diagram illustrating Embodiment 6 of a cymbal support according to the present disclosure.

FIG. 12 is an explanatory diagram illustrating Embodiment 6 of the cymbal support according to the present disclosure. A cymbal support 7 of Embodiment 6 includes a support part 70. The support part 70 has a solid inverted substantially bowl-shaped curved part 72 that a cymbal 300 comes into contact, and also has a through hole 78 at a central axis through which a stand shaft rod 100 penetrates.

An upper portion of the curved part 72 of the cymbal support 7 (support part 70) has a gently curved shape, and similarly to the cymbal support 5 (support part 50), the curved part 72 is short, and has a columnar base 74 being relatively tall on a side of a surface (bottom surface 76) that opposes a curved part 72 of the support part 70. The degree of curvature of the curved part 72 is more rounded, compared to the cymbal support 5 (support part 50).

A material, hardness and usage of the cymbal support 7 (support part 70) are similar to those of the cymbal support 1 (support part 10).

Embodiment 7

Figure 13:
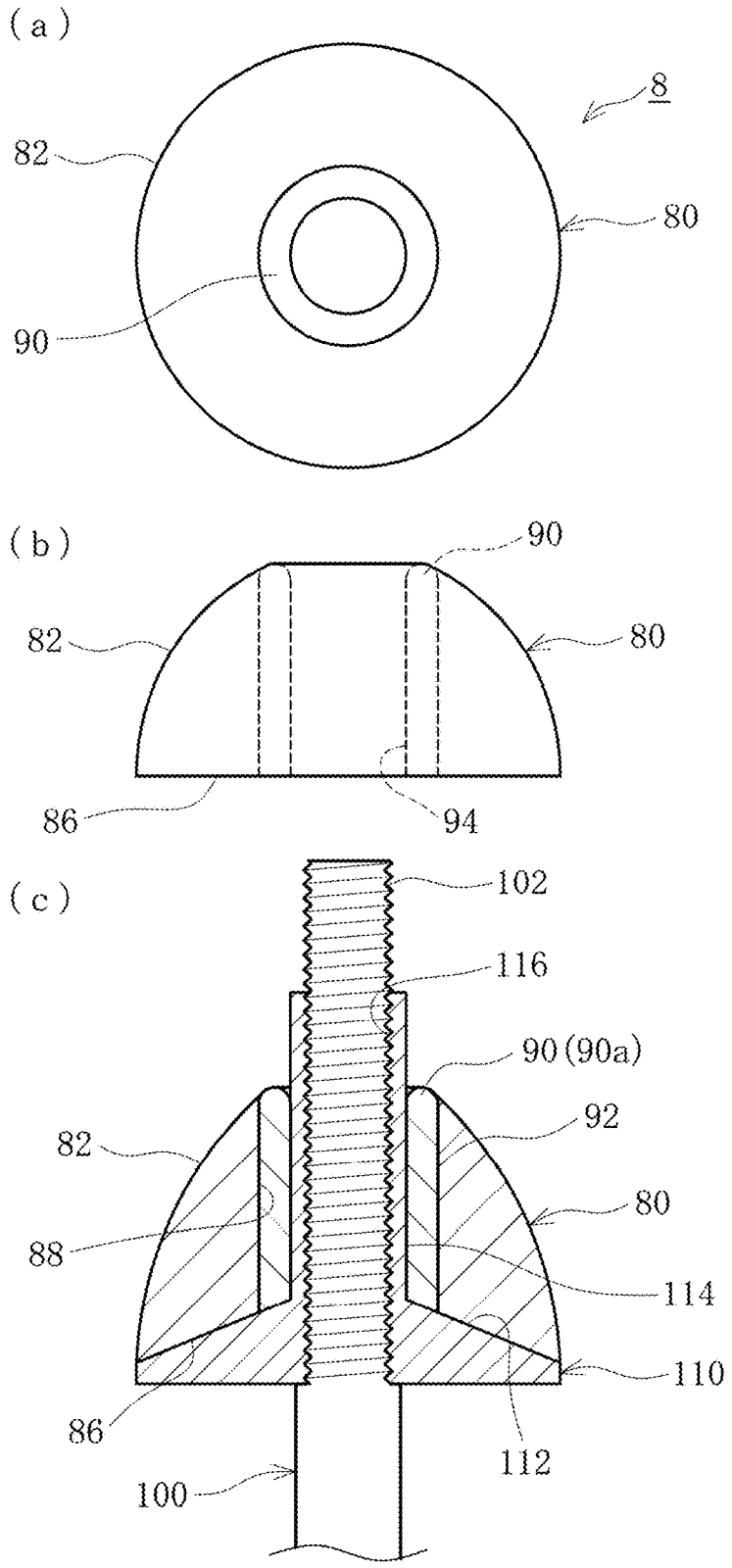
FIG. 13 is an explanatory diagram illustrating Embodiment 7 of a cymbal support according to the present disclosure.

FIG. 13 is an explanatory diagram illustrating Embodiment 7 of a cymbal support according to the present disclosure. The cymbal support 8 of Embodiment 7 includes a support part 80 and an insertion member 90, unlike other cymbal supports. The support part 80 has a solid inverted substantially bowl-shaped curved part 82, and also has a through hole 88 whose diameter is greater than the stand shaft rod 100 at a central axis. An insertion member 90 has a cylindrical shape, a tip portion 90*a* thereof is a curved part that the cymbal 300 contacts, includes a through hole 88 at a central axis, through which the stand shaft rod 100 penetrates, with an outer diameter that allows insertion into the through hole 88 of the support part 80.

In other words, on the whole, the cymbal support 8 has an equal shape and equal function by including the support part 80 and the insertion member 90. In addition, a materials of the support part 80 and the insertion member 90 of the cymbal support 8 is preferably a combination of leather, cork, felt, silicone resin and rubber sponge. Hardness of the support part 80 and the insertion member 90 is similar to that of the cymbal support 1 (support part 10). However, using materials having different hardness for the support part 80 and the insertion member 90 is possible. Moreover, usage of the cymbal support 8 is similar to that of the cymbal support 1 on the whole, as illustrated in FIG. 13C.

Embodiment 8

Figure 14:
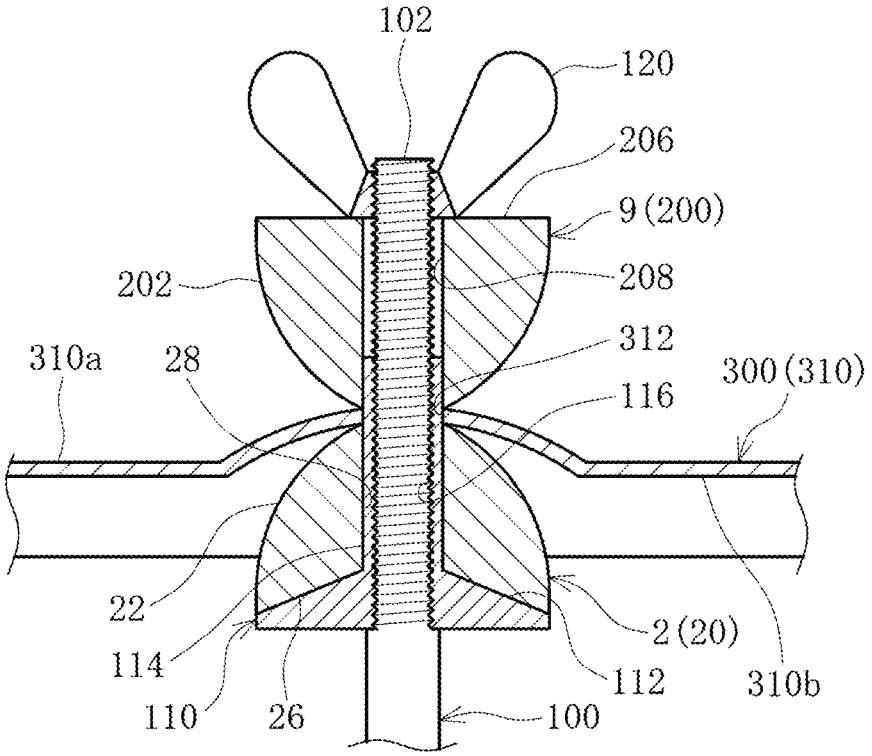
FIG. 14 is an explanatory diagram illustrating Embodiment 8 of a cymbal support according to the present disclosure.
Figure 15:
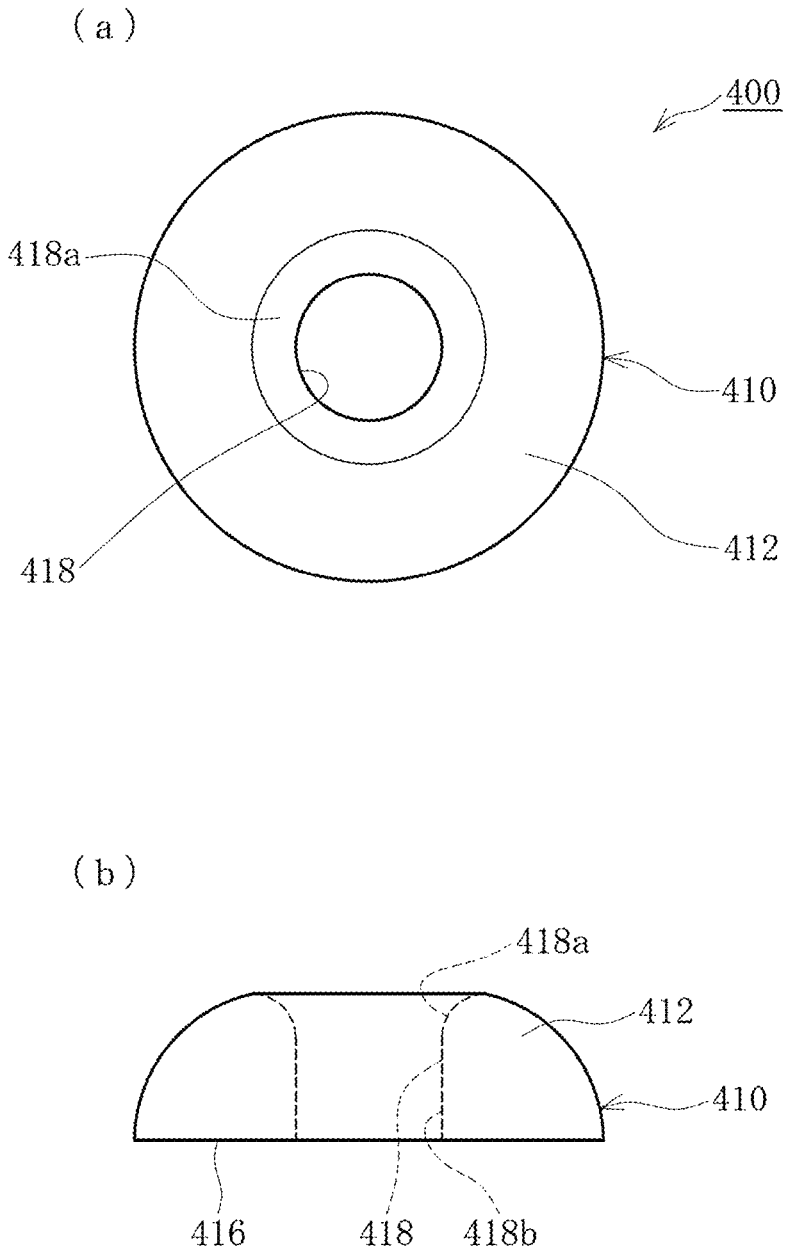
FIG. 15 is an explanatory diagram illustrating Embodiment 9 of a cymbal support according to the present disclosure.
Figure 16:
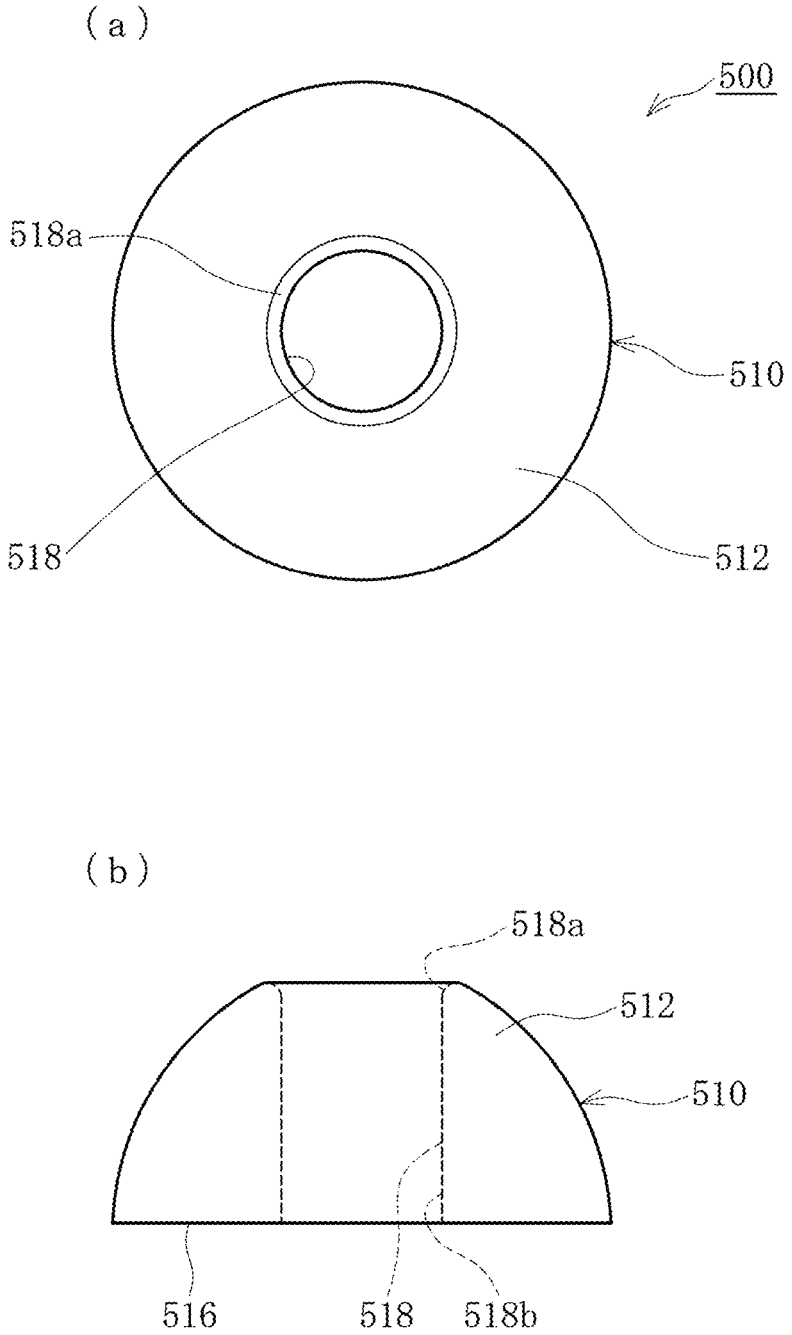
FIG. 16 is an explanatory diagram illustrating Embodiment 10 of a cymbal support according to the present disclosure.

FIG. 14 is an explanatory diagram illustrating Embodiment 8 of the cymbal support according to the present disclosure. In the present embodiment, other usage is described in addition to the above-described usage of the cymbal support. The cymbal support 2 (support part 20) illustrated in FIG. 14 is described above. The cymbal support 9 (support part 200) is similar to cymbal support 2 (support part 20).

Firstly, similar to the case illustrated in FIG. 3, the cymbal support 2 (support part 20) is fixed to the stand shaft rod 100 of the stand via a fixer 110, and the cymbal 300 is disposed thereon. Then, at the upper portion of the cymbal 300, the cymbal support 9 (support part 200) is arranged so that a curved part 202 thereof faces a side of the cymbal 300 (side of an upper surface 310*a*), and the stand shaft rod 100 penetrates through the through hole 208. Then, a butterfly screw 120 is screwed and fit to the screw 102 of the stand shaft rod 100 that projects from the through hole 208 so that an entirety is fixed.

The cymbal support 2 and cymbal support 9 are used for describing the usage, however, a combination of other cymbal supports may be used.

In other words, below of the cymbal 300, the cymbal support is arranged so that the curved part thereof faces the side of the cymbal by allowing the stand shaft rod to penetrate through the through hole, the cymbal is disposed on the upper portion of the cymbal support. At an upper portion of the cymbal, another cymbal support is arranged so that a curved part thereof faces the cymbal with the stand shaft rod penetrating through the through hole.

Embodiment 9

In the following embodiments, examples of forms being smaller than cymbal supports 1 that are the basic are described (however, the portion that corresponds to the base 24 of the cymbal support 1 is not included). The explanatory diagram illustrates Embodiment 9 of the cymbal support according to the present disclosure. A cymbal support 400 of Embodiment 9 includes a support part 410. The support part 410 has a solid inverted substantially bowl-shaped curved part 412 that a cymbal 300 comes into contact, and also has a through hole 418 at a central axis through which a stand shaft rod 100 penetrates. In addition, an opening 418*a* of the through hole 418 on the side of the curved part 412 of the support part 410 is chamfered in a curved shape.

A material, hardness and usage of the cymbal support 400 (support part 410) are similar to those of the cymbal support 1 (support part 10). For a size and a degree of curvature of the curved part 412 of the cymbal support 400 (support part 410), a diameter of a bottom surface 416 is approximately 32 mm, an overall height is approximately 10 mm, a degree of curvature of the curved part 412 is approximately 10.25 mm in radius. A degree of curvature of a curved-shape chamfering of an opening 418*a* is approximately 3 mm in radius.

Embodiment 10

In the following embodiment, an example of a form being similar to the cymbal support 1 that is the basic, and preferable in use on the sound of the cymbal 300 (however, a portion corresponding to the base 24 of the cymbal support 1 is not included) is described. The explanatory diagram illustrates Embodiment 10 of the cymbal support according to the present disclosure. A cymbal support 500 of Embodiment 10 includes a support part 510. The support part 510 has a solid inverted substantially bowl-shaped curved part 512 that a cymbal 300 comes into contact, and also has a through hole 518 at a central axis through which a stand shaft rod 100 penetrates. In addition, an opening 518*a* of the through hole 518 on a side of the curved part 512 of the support part 510 is chamfered in a curved shape.

A material and usage of the cymbal support 500 (support part 510) are similar to those of the cymbal support 1 (support part 10), however, the hardness is 40. For a size and a degree of curvature of the curved part 512 of the cymbal support 500 (support part 510), a diameter of a bottom surface 516 is 34 mm, an overall height is 17 mm, a degree of curvature of the curved part 512 is 25.5 mm in radius. A degree of curvature of the curved-shape chamfering of the opening 518*a* is 1 mm in radius.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2016-213991, filed on Nov. 1, 2016, the entire disclosure of which is incorporated by reference herein.

INDUSTRIAL APPLICABILITY

As described above, the present disclosure provides a cymbal support that reduces suppressing of movement and vibration of a cymbal while supporting the cymbal, and usage thereof.

REFERENCE SIGNS LIST

1 Cymbal support
2 Cymbal support
3 Cymbal support
4 Cymbal support
5 Cymbal support
6 Cymbal support
7 Cymbal support
8 Cymbal support
9 Cymbal support
10 Support part
12 Curved part
14 Base
16 Bottom surface
18 Through hole
18*a* Opening
18*b* Opening
20 Support part

22 Curved part
24 Base
26 Bottom surface
28 Through hole
28*a* Opening
30 Support part
32 Curved part
38 Bottom surface
38 Through hole
38*a* Opening
40 Support part
42 Curved part
46 Bottom surface
48 Through hole
50 Support part
52 Curved part
54 Base
56 Bottom surface
58 Through hole
60 Support part
62 Curved part
64 Base
66 Bottom surface
68 Through hole
70 Support part
72 Curved part
74 Base
76 Bottom surface
78 Through hole
80 Support part
82 Curved part
86 Bottom surface
88 Through hole
90 Insertion member
90*a* Tip portion
92 Peripheral surface
94 Through hole
100 Stand shaft rod
102 Screw
110 Fixer
112 Plate
114 Cylinder
116 Screw thread portion
120 Butterfly screw
200 Support part
202 Curved part
206 Bottom surface
208 Through hole
300 Cymbal
310 Cymbal part
310*a* Upper surface
310*b* Lower surface
312 Cymbal hole
400 Cymbal support
410 Support part
412 Curved part
416 Bottom surface
418 Through hole
418*a* Opening
418*b* Opening
500 Cymbal support
510 Support part
512 Curved part
516 Bottom surface
518 Through hole
518*a* Opening
518*b* Opening

The invention claimed is:

1. A cymbal support for holding a cymbal on a shaft rod of a stand, the cymbal support comprising:

a curved part having a solid inverted bowl shape, the curved part being configured to attach to the cymbal; and a support part having a through hole at a central axis through which the shaft rod penetrates, wherein an opening of the through hole on a curved part side of the support part is chamfered in a curved shape or straightly.

2. The cymbal support according to claim 1, wherein a chamfering of the opening of the through hole on the curved part side of the support part is in a curved shape with a radius from 1 mm to 3 mm.

3. A cymbal support for holding a cymbal on a shaft rod of a stand, the cymbal support comprising:

a curved part having a solid inverted bowl shape, the curved part being configured to attach to the cymbal; and a support part having a through hole at a central axis through which the shaft rod penetrates, wherein the support part is 25 degrees to 80 degrees in hardness.

4. A cymbal support for holding a cymbal on a shaft rod of a stand, the cymbal support comprising:

a curved part having a solid inverted bowl shape, the curved part being configured to attach to the cymbal; and a support part having a through hole at a central axis through which the shaft rod penetrates, wherein the support part is 8 mm to 30 mm in height, 20 mm to 45 mm in diameter of a bottom surface, and 10 mm to 30 mm in radius of a degree of curvature of the curved part.

5. The cymbal support according to claim 1, wherein the support part comprises a columnar base on a side facing the curved part.

6. The cymbal support according to claim 1, wherein the support part comprises a columnar base on a side facing the curved part, and a chamfering of the opening of the through hole on the curved part side of the support part is in a curved shape with a radius from 1 mm to 3 mm.

7. The cymbal support according to claim 3, wherein the support part comprises a columnar base on a side facing the curved part.

8. The cymbal support according to claim 4, wherein the support part comprises a columnar base on a side facing the curved part.

9. The cymbal support according to claim 1, wherein a material of the support part is one of, or a combination of two of more of leather, cork, felt, silicone resin and rubber sponge.

10. The cymbal support according to claim 1, wherein the support part is 25 degrees to 80 degrees in hardness.

11. The cymbal support according to claim 1, wherein the support part is 8 mm to 30 mm in height, 20 mm to 45 mm in diameter of a bottom surface, and 10 mm to 30 mm in radius of a degree of curvature of the curved part.

12. The cymbal support according to claim 1, wherein a material of the support part is one of, or a combination of two of more of leather, cork, felt, silicone resin and rubber sponge, the support part is 17 mm in height, 34 mm in diameter of a bottom surface, 40 degrees in hardness, and 25.5 mm in radius of a degree of curvature of the curved part, and the opening of the through hole on the curved part side of the support part is chamfered in a curved shape with a radius of 1 mm.

* * * * *